United States Patent [19]

Lauritsen

[11] Patent Number: 4,579,505

[45] Date of Patent: Apr. 1, 1986

[54] CAR TUMBLER AND SAFETY DEVICE THEREFOR

[76] Inventor: Folmer A. W. Lauritsen, DK-2500, Valby, Denmark

[21] Appl. No.: 674,137

[22] Filed: Nov. 23, 1984

[30] Foreign Application Priority Data

Nov. 24, 1983 [DK] Denmark ..... 5373/83
Nov. 24, 1983 [DK] Denmark ..... 5374/83

[51] Int. Cl.[4] ..... B66F 7/22

[52] U.S. Cl. ..... 414/678; 403/93; 403/95; 414/778

[58] Field of Search ..... 414/358, 678, 778, 779, 414/781; 280/47.12, 47.33; 248/168, 188.6, 439; 403/93, 95; 269/55

[56] References Cited

U.S. PATENT DOCUMENTS

| | | | |
|---|---|---|---|
| 1,334,336 | 3/1920 | Weimar | 414/678 X |
| 1,399,641 | 12/1921 | Mize et al. | 414/678 X |
| 1,534,346 | 4/1925 | White | 280/47.12 |
| 2,911,245 | 11/1959 | Kurz | 403/95 |
| 3,169,741 | 2/1965 | Bittner | 248/439 X |
| 3,674,252 | 7/1972 | Crabtree et al. | 414/678 X |

FOREIGN PATENT DOCUMENTS

| | | | |
|---|---|---|---|
| 206791 | 9/1955 | Australia | 414/678 |
| 1129868 | 9/1956 | France | 414/678 |
| 369179 | 8/1974 | Sweden | 414/678 |
| 930486 | 7/1963 | United Kingdom | 414/678 |

*Primary Examiner*—Leslie J. Paperner
*Attorney, Agent, or Firm*—Holman & Stern

[57] ABSTRACT

A car tumbler comprises a set of quarter circle-formed rockers (1) for placing under the car to be rolled over on its side, a hub flange (5) on each rocker for engagement with a wheel hub in one side of the car, the car tumbler being manipulated by a single person from only that one side of the car and requiring only dismounting the wheels on that one side, and a wheel carriage (4) on one end of each rocker which is devised in such a way that when the rocker is passed under the car the wheel carriage will engage with the inward side of and surround part of the lowermost periphery of the wheel on the other side of the car. A safety device to prevent the car rolling backward during tumbling and return to its horizontal position without any risk comprises a rotatable ratchet wheel (20) to which sustain leg (21) is welded and a main support foot (22) is connected which is parallel to the rolling axis and which in the starting position of the tumbler is in engagement with the base, a pawl (23,23') having a pawl spring (24) and a manipulation bar (25) which extends to the end of the rocker (1) and is freely accessible, and an auxiliary support foot (22) which extends in the opposite direction thereto and which is also in engagement with the base in the starting position of the tumbler. The safety device provides a considerable rigidity and stability in the longitudinal direction of the tumbler during the mounting and dismounting thereof.

3 Claims, 3 Drawing Figures

FIG. 1
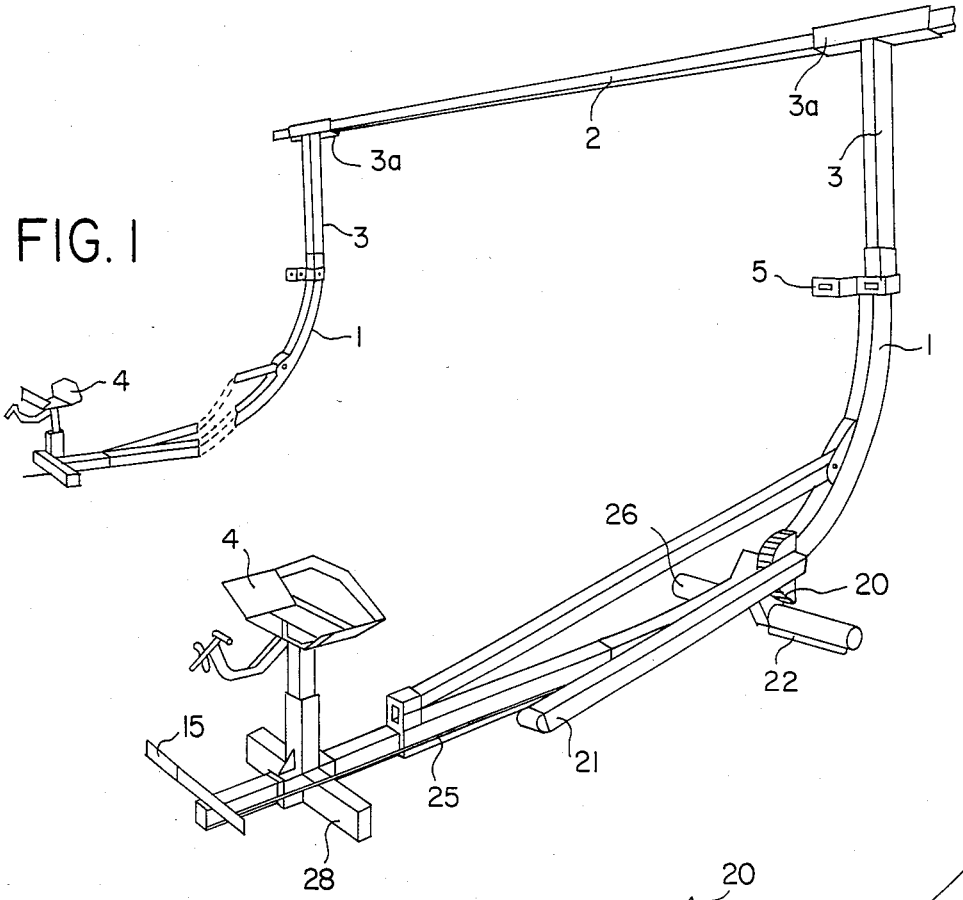
FIG.2
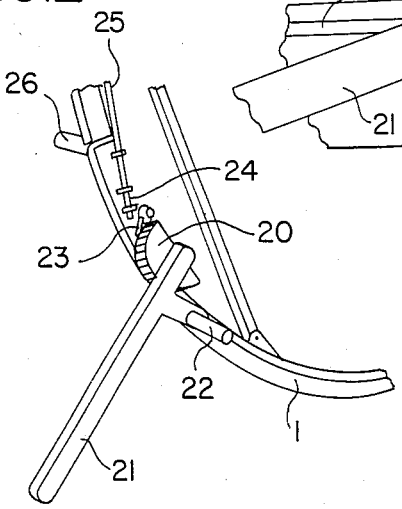
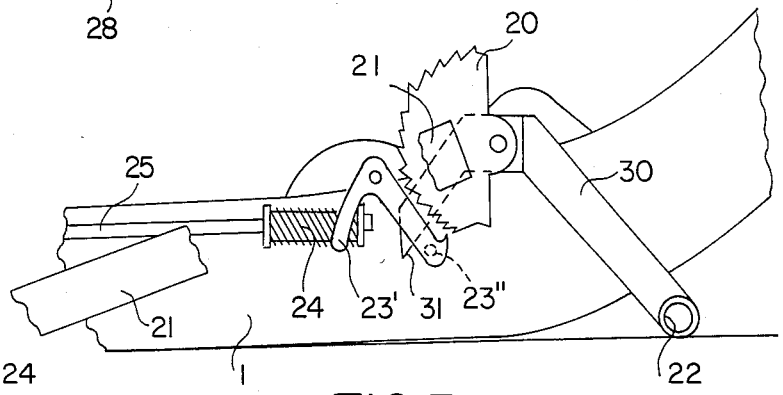
FIG.3

CAR TUMBLER AND SAFETY DEVICE THEREFOR

BACKGROUND OF THE INVENTION

Field of the Invention

The invention relates to a car tumbler for rolling a car over on its side and a safety device having a sustain leg for the car tumbler.

From British patent specification No. 1,308,450 there is known a car tumbler in which it is only necessary to dismount the wheels in one side of the car and to have unrestricted access to the same side of the car while the other side of the car may be close to a garage wall, for example. However, this car tumbler only extends a short distance below the car and can therefore not be tilted by a single man but requires a hoist or many hands.

From British patent specification No. 930,486 there is known a car tumbler which passes well under the car and which may therefore be more easily manipulated than the above-mentioned known car tumbler. However, here all four wheels have to be dismounted so as to make it possible to fasten the car tumbler to all four wheel hubs and therefore it is necessary to have access to both sides of the car.

From British patent specification No. 1,308,450 there is also known a car tumbler on which a leg may be mounted when the car has been rolled completely over on its side but which has to be removed before the car is to be turned back into its normal position.

From Swedish patent specification No. 369,179 there is known a car tumbler having an expensive hydraulically manipulated sustain leg.

BRIEF SUMMARY OF THE INVENTION

The purpose of the invention is to provide a car tumbler of the type concerned which can be manipulated from exclusively one side of the car while the other side of the car may be close to a wall, which only requires demounting of the wheels in one side of the car, and which can be manipulated by one man alone.

The safety device is simple and reliable and provides a considerable rigidity and stability in the longitudinal direction of the tumbler during its mounting and dismounting.

The fact that there is preferably arranged an auxiliary support foot rigidly connected to the rocker is to be understood in the sense that this auxiliary support foot might have been omitted if the width of the rocker were the same as the length of the auxiliary support foot whose intended purpose is to contribute to preventing the car from tilting in its longitudinal direction during the mounting and dismounting of the other rocker, the rocker having the safety device being mounted first and dismounted last.

A main support foot projecting in the opposite direction of the auxiliary support foot is, however, also desirable for the same purpose, but in order that it may not provide an obstruction for the rotary movement of the ratchet wheel together with the sustain leg the main support foot is in permanent or non-permanent connection with these components and in order that it may have a stabilizing effect in the longitudinal direction in the same way as the auxiliary support foot, which is in rigid connection with the rocker, the main support foot may be clamped by the pawl and ratchet wheel obtaining a locking engagement in the horizontal position of the car tumbler so that the wheel carriage is held in engagement with the base.

Finally the free end of the sustain leg will constitute an additional point of support for the car tumbler when the pawl and the ratchet wheel are in locking engagement.

When the ratchet wheel is released and when the wheel carriage is lifted from the base the sustain leg will continuously prevent the car from tilting backward to a horizontal position during its tilting movement into the vertical position.

By means of the safety device according to the invention it is therefore possible to tilt the car without risk of rolling backward and in the same way the car may without any risk be brought into its horizontal position by stepwise release of the pawl.

Likewise, the mounting of the rocker with the safety device first, viz. under the heaviest end of the car, and the mounting of the other rocker may take place without any risk of the car tumbler tilting in the longitudinal direction of the car.

An especially effective preventing of the car tilting in the longitudinal direction is obtained by means of the safety device according to a further embodiment in which the main support foot is placed farther away from the free end of the sustain leg.

BRIEF DESCRIPTION OF THE DRAWINGS

The invention will be further described with reference to the accompanying drawing wherein:

FIG. 1 is a perspective view of an embodiment of the apparatus and the safety device according to the invention, the car tumbler being shown in its starting position;

FIG. 2 is a detailed perspective view of the rocker carrying the safety device, shown in a stage of the tilting movement; and FIG. 3 is an elevational view of a detail of another embodiment of the safety device according to the invention in its starting position.

DETAILED DESCRIPTION

The car tumbler shown in the drawing consists of two substantially identical quarter circle-formed rockers 1 and a horizontal connection bar 2 between them. Each rocker is at its topmost end provided with a T 3 whose horizontal bushing 3*a* surrounds the bar 2 in telescoping engagement so that the rocker may slide along the bar and be locked in various positions. At the opposite end of each rocker there is a wheel carriage 4 which may engage the inward side of a tire and surround part of its periphery. At a distance from each wheel carriage corresponding to the wheel distance (tread) of the car there is mounted a hub flange 5 which can be clamped to the wheel hubs by means of bolts.

By means of devices not shown in further details the wheel carriage is adjustable in vertical and horizontal level for adapting to the wheel distance of the car (tread) and its gravity center distance. It has a rim strap.

The two rockers are mounted one at a time under the car. In connection with this work an ordinary shop jack is used for lifting the car. The rockers are mounted in such a way that the wheels on one side of the car rest upon the wheel carriages 4 while the wheel hubs on the opposite side rest against the hub flanges 5. The hub flanges are clamped to the wheel hubs by using the wheel bolts. When the rockers have been placed under the car the bar 2 is mounted in the bushings 3*a* and locked by means of clamping screws (not shown). The car may now be rolled over on its side, approximately 90°.

In its rolled-over position the car tumbler rests on the T's 3 whose flat form bring about the necessary stability. In connection with the general geometry of the car tumbler the height of the wheel carriages 4 results in the car being kept in a position relative to the car tumbler in which the longitudinal axis of the center of gravity substantially coincides with the rolling axis. This further contributes to the fact that the car tumbler can be manipulated manually and that the risk of using the car tumbler is minimal.

The car tumbler carries the safety device according to the invention on one of the rockers 1. This safety device comprises a ratchet wheel 20 rotatably mounted in the center part of the rocker 1. Rigidly connected thereto is a sustain leg 21 and perpendicular to the latter is mounted a main support foot 22, viz. permanently mounted according to FIGS. 1 and 2 but non-permanently mounted according to FIG. 3.

Likewise, there is an auxiliary support foot 26 rigidly connected with the rocker 1. A further support foot 28 is also provided at the bottom of wheel carriage 4.

Engaging the ratchet wheel 20 there is a pawl 23 (FIGS. 1 and 2) or 23' (FIG. 3), a pawl spring 24 and a manipulation bar 25 these parts being carried by the rocker. The manipulation bar 25 is devised so as to be able to lock the pawl so that the ratchet wheel cannot rotate, a release device 15 being activated by means of the foot before the rolling over of the car and by means of the hand before the rolling back into the horizontal position.

In use, the rocker 1 carrying the safety device is mounted first under the heaviest end of the car. The ratchet wheel being locked both support feet 22 and 26 and the free end of the sustain leg 21 and naturally also the wheel carriage 4 and fast 28 thereof will prevent the tilting of the car in its longitudinal direction during the mounting of the other rocker.

The locking of the support foot 22 in the embodiment of FIG. 3 is obtained through the specific construction according to this embodiment as follows: the main support foot 22 is placed at one end of a rotatable hooked lever 30 having the same rotation axis as the ratchet wheel 20. The other end of the hooked lever 30 is shaped as a nose 31. The pawl has the form of an angular pawl 23' whose free end opposite to the manipulation bar 25 carries a stud 23'' intended for locking engagement with the nose 31. It is easily seen from FIG. 3 that the stud 23'' in the starting position of the car roller will lock the car tumbler so as not to roll over until the ratchet wheel has been released.

When the rolling over of the car is to take place the ratchet wheel is released. The ratchet wheel will counteract the opposite movement so that the tumbling of the car takes place completely without risk.

When rolling the car back to its normal horizontal position one releases at intervals the lock engagement between the pawl and the ratchet wheel.

I claim:

1. In a car tumbler including a set of substantially quarter-circle rockers for placing on a base under the car setting on the base and being engageable with the wheels or wheel hubs thereof to enable in the mounted position rolling the car over on its side on the rockers, and a hub flange connector near the center of each rocker engageable with a wheel hub on one side of the car, the improvement comprising:

a wheel carriage mounted on each rocker adjacent the end thereof inserted under the car having a shape to engage the inward side and surround part of the lowermost periphery of the wheel on the other side of the car;

a rotatable ratchet wheel rotatably mounted on one of said rockers in the central part thereof;

a sustain leg rigidly connected to said ratchet wheel;

a main support foot rotatably mounted on said one of said rockers and extending parallel to the rolling axis of the tumbler, and which is in engagement with the base in the starting position of the tumbler;

a pawl pivotally mounted on said one rocker operatively engageable with said ratchet wheel for locking said ratchet wheel against rotation relative to said one rocker when engaged with said ratchet wheel;

a pawl spring operatively mounted on said one rocker and engaging said pawl for resiliently urging said pawl into the engaged position with said ratchet wheel;

a pawl manipulating bar movably mounted on said one rocker in engagement adjacent one end thereof with said pawl for operating said pawl and extending to the end of said one rocker adjacent said wheel carriage in freely accessible position for movement to release said pawl from engagement with said ratchet wheel; and an auxiliary support foot mounted on said one rocker and extending parallel and in the opposite direction relative to said main support foot and engaging said base in the starting position of said tumbler.

2. A safety device as claimed in claim 1 wherein:

said main support foot is mounted on said sustain leg.

3. A safety device as claimed in claim 1 wherein:

said main support foot comprises a hook shaped lever rotatable about the same axis as said ratchet wheel and has a pawl engaging nose on one end; and said pawl comprises an angular shaped member having one end engaged with said manipulating bar and a stud element on the other free end adjacent said ratchet wheel engageable with said pawl engaging nose for locking said main support foot when engaged with said nose against rotation relative to said one rocker.

* * * * *